US007491056B2

(12) United States Patent
Knoepfel

(10) Patent No.: US 7,491,056 B2
(45) Date of Patent: Feb. 17, 2009

(54) PREMIX BURNER

(75) Inventor: Hans Peter Knoepfel, Dottikon (CH)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 11/741,002

(22) Filed: Apr. 27, 2007

(65) Prior Publication Data

US 2007/0202453 A1 Aug. 30, 2007

Related U.S. Application Data

(63) Continuation of application No. PCT/EP2005/055612, filed on Oct. 27, 2005.

(30) Foreign Application Priority Data

Nov. 3, 2004 (CH) ..... 1814/04

(51) Int. Cl.
*F23D 14/62* (2006.01)

(52) U.S. Cl. ..... 431/354; 431/351; 431/352

(58) Field of Classification Search ..... 431/351, 431/352, 354, 350, 4, 8, 9, 10, 12; 60/737, 60/738

See application file for complete search history.

(56) References Cited

U.S. PATENT DOCUMENTS 6,019,596 A * 2/2000 Knopfel et al. ..... 431/350

FOREIGN PATENT DOCUMENTS

| | | |
|---|---|---|
| DE | 19527453 | 1/1997 |
| EP | 0321809 | 6/1989 |
| EP | 0704657 | 4/1996 |
| EP | 0756133 | 1/1997 |
| WO | WO2006/048405 | 5/2006 |

OTHER PUBLICATIONS

Search Report for Swiss Patent App. No. 01814/04 (Feb. 8, 2005).
International Preliminary Report on Patentability for PCT Patent App. No. PCT/EP2005/055612 (Feb. 7, 2007).

* cited by examiner

*Primary Examiner*—Alfred Basichas
(74) *Attorney, Agent, or Firm*—Cermak Kenealy Vaidya & Nakajima LLP; Adam J. Cermak

(57) ABSTRACT

A premix burner for a heat generator has partial cone shells (5) which make up a vortex generator, and which encompass a conically widening vortex chamber (6) and mutually define tangential air inlet slots (7), and also with feeds for gaseous and/or liquid fuel, of which at least one is arranged along the air inlet slots (7) on the partial cone shells (5), and at least one other is arranged along a burner axis (A) which centrally passes through the vortex chamber (6). At least n partial cone shells (5) encompass the vortex chamber (6), and define n air inlet slots (7), with n≧3, preferably n≧5, the n air inlet slots (7) each have at least a maximum slot width (10) which is equal to or larger than that slot width (10) which a generic type premix burner (1) of the same size and dimensioning with m≦2 partial cone shells (5) and m air inlet slots (7) has.

4 Claims, 2 Drawing Sheets

PREMIX BURNER

This application is a Continuation of, and claims priority under 35 U.S.C. § 120 to, International application number PCT/EP2005/055612, filed 27 Oct. 2005, and claims priority therethrough under 35 U.S.C. §119 to Swiss application number 01814/04, filed 3 Nov. 2004, the entireties of which are incorporated by reference herein.

BACKGROUND

1. Field of Endeavor

The invention relates to a premix burner for a heat generator, with partial cone shells which make up a vortex generator, and which encompass a conically widening vortex chamber and mutually define tangential air inlet slots, and also with feeds for gaseous and/or liquid fuel, of which at least one is arranged along the air inlet slots on the partial cone shells, and at least one other is arranged along a burner axis which centrally passes through the vortex chamber.

2. Brief Description of the Related Art

Generic type premix burners have effectively been used for many years for firing combustion chambers to drive gas turbine plants, and represent largely perfected components with regard to their burner characteristics. Depending upon application and desired burner capacity, generic type premix burners are available which are optimized both with regard to burner capacity and also from the point of view of reduced emission of pollutants.

Such a premix burner is to be gathered from EP 0 321 809 B1, which premix burner basically includes two hollow, conical body sections which fit one inside the other in the flow direction, the respective longitudinal symmetry axes of which extend in an offset manner to each other so that the adjacent walls of the body sections in their longitudinal extent form tangential slots for a combustion air flow. Liquid fuel is preferably injected through a central nozzle into the vortex chamber which is encompassed by the body sections, while gaseous fuel is introduced through the additional nozzles which are present in the region of the tangential air inlet slots in the longitudinal extent.

The burner concept of the aforementioned premix burner is based on the generation of a closed vortex flow inside the conically widening vortex chamber. The vortex flow, however, on account of the increasing vortex in the flow direction inside the vortex chamber, becomes unstable and changes into an annular vortex flow with a backflow zone in the flow core. The location at which the vortex flow changes into an annular vortex flow with a backflow zone by means of bursting is basically determined by the cone angle which is inscribed by the partial cone shells, and also by the slot width of the air inlet slots. In the case of the selection for dimensioning of the slot width and also of the cone angle, by which the overall length of the burner is ultimately determined, narrow limits are basically set so that a desired flow field is established, which leads to the formation of a vortex flow which in the burner mouth region bursts into an annular vortex flow, forming a spatially stable backflow zone, in which the fuel-air mixture ignites, forming a spatially stable flame. A reduction in size of the air inlet slots basically leads to an upstream shift of the backflow zone, as a result of which, however, the mixture of fuel and air then ignites temporally and spatially earlier.

On the other hand, in order to position the backflow zone which is formed further downstream, i.e., to obtain a longer premix path or evaporation path, a mixing path in the form of a mixer tube, which transmits the vortex flow, is provided downstream of the vortex generator, as it is described in detail, for example, in EP 0 704 657 B1. In this publication, a vortex generator which includes four partial cone bodies is to be gathered, to which vortex generator a mixing path, which serves for a further mixing-through of the fuel-air mixture, is connected downstream.

Transfer passages are provided for continuous transfer of the vortex flow which issues from the vortex generator into the mixing path, which transfer passages extend between the vortex generator and the mixing path in the flow direction and serve for the transfer of the vortex flow which is formed in the vortex generator into the mixing path which is connected downstream to the transfer passages.

In addition to the constructional burner design, the feed of liquid fuel also has a decisive influence on the flow dynamics of the vortex flow which is formed inside the vortex generator and also of the backflow zone which is formed as spatially stably as possible downstream of the vortex generator. In this way, with a typical feed of liquid fuel along the burner axis, a rich fuel-air mixture, which is formed along the burner axis, becomes apparent at the location of the cone apex of the conically widening vortex chamber, especially in premix burners of larger design, as a result of which the risk of the so-called backflash in the region of the vortex chamber increases. Such backflashes lead on the one hand inevitably to high NOx emissions, particularly through which fuel-air mixture portions which are not completely mixed through are combusted. On the other hand, backflash occurrences are hazardous especially because of this and are to be avoided since they can lead to thermal and also mechanical stresses and, as a consequence of this, can lead to irreversible damage to the structure of the premix burner.

By means of the burner design which is described above, which is adapted in an optimized manner to the desired burner conditions in each case, it is clear that by mere size scaling of all premix burner components to form a larger burner with larger capacity, the desired burner characteristics are not also automatically maintained. If, in this way, for example the mass flow of a gas turbine is not linearly scaled to the geometric scaling factor of individual gas turbine components, but is largely quadratic, i.e., the output is to be doubled by size adjustment of the gas turbine plant, it is necessary to provide four times as much air for the combustion process. This has the result that, for each individual gas turbine plant, which differs by size and power factor, a completely new burner, and especially a completely new premix burner, has to be designed and built, which it is necessary to adapt to the desired optimized burner characteristics in a suitable manner. This incurs high costs which it is necessary to avoid. A large number of individual burners are arranged in a circular arrangement around a combustion chamber especially in high-output gas turbine plants in order to achieve an optimum burner performance with regard to burner capacity and also pollutant emissions, depending upon gas turbine output. It is clear, moreover, that single-row burner arrangements, but especially double-row or multi-row burner arrangements, around in each case one combustion chamber, demand large constructional volumes.

The preceding embodiments show that a power output variation in the sense of a power output increase of a gas turbine plant by the currently known means inevitably necessitates a complete new construction of a hitherto known conically formed premix burner. In this case, it is necessary to take remedial action and to search for measures in order to enable a desired scaling of gas turbine plants also to the premix burners which are currently in operation, and with only minor structural changes to existing premix burner systems.

SUMMARY

One of numerous aspects of the present invention includes developing a premix burner for a heat generator, especially for firing a combustion chamber to drive a gas turbine plant, with partial cone shells which make up a vortex generator, and which encompass a conically widening vortex chamber and mutually define tangential air inlet slots, and also with feeds for gaseous and/or liquid fuel, of which at least one is arranged along the air inlet slots on the partial cone shells, and at least one other is arranged along a burner axis which centrally passes through the vortex chamber, in such a way that even in larger dimensioned gas turbine plants which require a larger burner load, its use becomes possible without the constructional design of the premix burner having to be significantly altered.

Despite the measures which maximize the burner capacity, it is especially necessary to keep the pollutant emission which is produced by the burner as low as possible. A further desirable aspect concerns the overall size of such a premix burner which is to be kept as compact and small as possible. Naturally, it is necessary, moreover, to always ensure the operational safety of a premix burner which is modified according to the invention, and, despite the measures which increase the burner capacity, to minimize (as much as completely excluding) the increasing risk regarding backflash occurrences in high-capacity burner systems.

Features which advantageously develop principles of the present invention are to be gathered from the description, especially with reference to the exemplary embodiments.

Another aspect of the present invention is based on the concept of increasing the swallowing capacity of an as known per se premix burner which is adapted in an optimized manner to a corresponding burner capacity, without at the same time altering the geometry dimensions which determine the overall size of the premix burner, like length and diameter of the premix burner.

According to yet another aspect of the present invention, an exemplary premix burner includes at least n partial cone shells when encompass the vortex chamber and define n air inlet slots, wherein $n \geqq 3$. The n air inlet slots have at least a maximum slot width in each case which is equal to or larger than that slot width which a generic type premix burner of the same size and dimensioning, i.e., burner diameter and burner length, with $m \leqq 2$ partial cone shells and m air inlet slots has.

By the increase in the number n of air inlet slots which are defined in each case by a corresponding number n of partial cone shells, the compact burner design can be basically maintained in an unaltered way and, at the same time, circumvents the problem of an increased fuel distribution through the central liquid fuel injection in the center of the burner, especially as the velocity of the air flows which flow through the premix burner increases in the same measure, by which the air throughput, and therefore the swallowing capacity of the premix burner, is also increased. This is also the reason for the risk of a backflash being able to be significantly reduced despite larger burner capacities. On the other hand, however, an increase of the so-called burner nominal velocity leads to the formation of a spatially stable backflow zone downstream of the burner and the flame stabilization, which is associated with it, being affected. In order to accordingly take into account the flame stabilization, it is necessary to correspondingly reduce the flow velocity of the fuel-air mixture which is formed and which issues from the premix burner. In the case of a premix burner, in which a mixer tube is connected downstream of the vortex generator, the inner contour of the mixer tube is formed in the flow direction as a diffuser, i.e., in a preferred embodiment the inner contour of the mixer tube is widened by a suitably predetermined cone angle $\alpha$ relative to the flow axis.

In the case of a premix burner without a mixer tube which is connected downstream, an increase of the number of air slots leads to a shift of the backflow bubble to the burner outlet. As a result, the premixing is also improved and lower emission values also ensue.

BRIEF DESCRIPTION OF THE DRAWINGS

The invention is exemplarily described below, based on exemplary embodiments with reference to the drawings, without limitation of the general inventive idea. In the drawings.

DETAILED DESCRIPTION OF EXEMPLARY EMBODIMENTS

Figure 1:
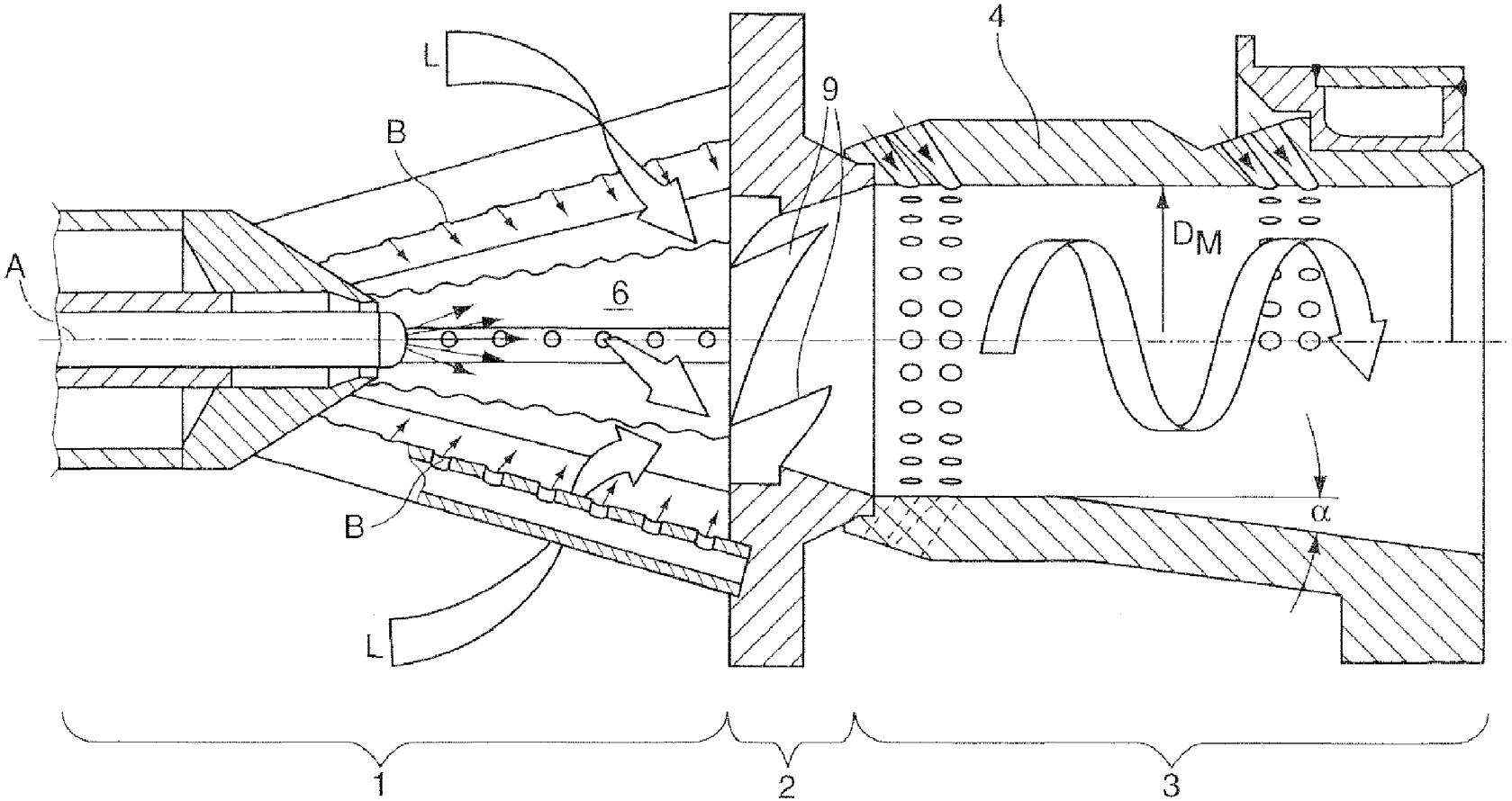
FIG. 1 shows a longitudinal cross section through a burner arrangement, with a conically formed premix burner with adjacent mixer tube, the upper partial cross-sectional half of which corresponds to the prior art, and the lower partial cross-sectional half of which corresponds to an embodiment according to the solution.
Figure 2:
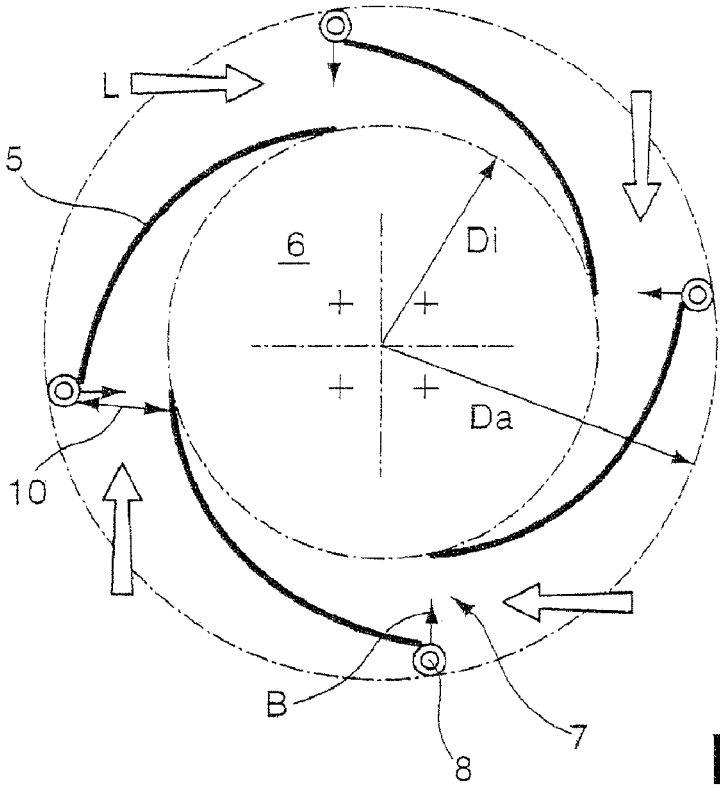
Fig. 2 (Prior Art)
FIG. 2 shows a cross-sectional view through an as known per se vortex generator (prior art) and also

In FIG. 1, a longitudinal sectional view through a burner arrangement is shown, which burner arrangement basically has three sub-components: a conically formed premix burner 1, a transition piece 2, and also a mixing path 3 which is formed in the form of a tubular mixing element 4. The upper half of the longitudinal sectional view according to FIG. 1 represents an as known per se premix burner arrangement, with a vortex generator 1, the vortex chamber of which is encompassed by n=4 partial cone shells 5 which altogether define n=4 air inlet slots 7. A cross-sectional view of such a known vortex generator 1 is shown in FIG. 2. The four partial cone shells 5, which encompass an inner vortex chamber 6, are clearly apparent from this view. The four air inlet slots 7 define an outside premix burner diameter Da, and also an inside diameter Di which defines the size of the vortex chamber 6. In addition, the respective mutual spatial offset of the partial cone shells with regard to their partial cone shell middle points, which are indicated by a cross in each case, is to be gathered from the cross-sectional view according to FIG. 2. By means of the respective air inlet slots 7, both air L, which is indicated by the large arrows in each case, and preferably gaseous fuel B, by corresponding feed lines 8 which are provided on the leading edges of the partial cone shells 5, reach the inside of the vortex generator 1. Inside the vortex generator 1, a vortex flow is formed, which axially propagates downstream along the burner axis A (see FIG. 1).

The transition piece 2, which in the flow direction is arranged downstream in the premix burner 1, serves for a largely loss-free transfer of the vortex flow, which is formed inside the vortex generator 1, into the mixing path 3 which is connected downstream. For this purpose, transfer passages 9 are provided in the transition piece 2, which transfer passages are formed for a corresponding flow transfer. Inside the mixing path 3, the fuel-air mixture is completely mixed in a tubular mixing element 4 with up to now constant flow diameter $D_M$, and after exit from the mixer tube 4 is ignited inside a combustion chamber, which is not shown, forming a spatially stable backflow zone.

Figure 3:
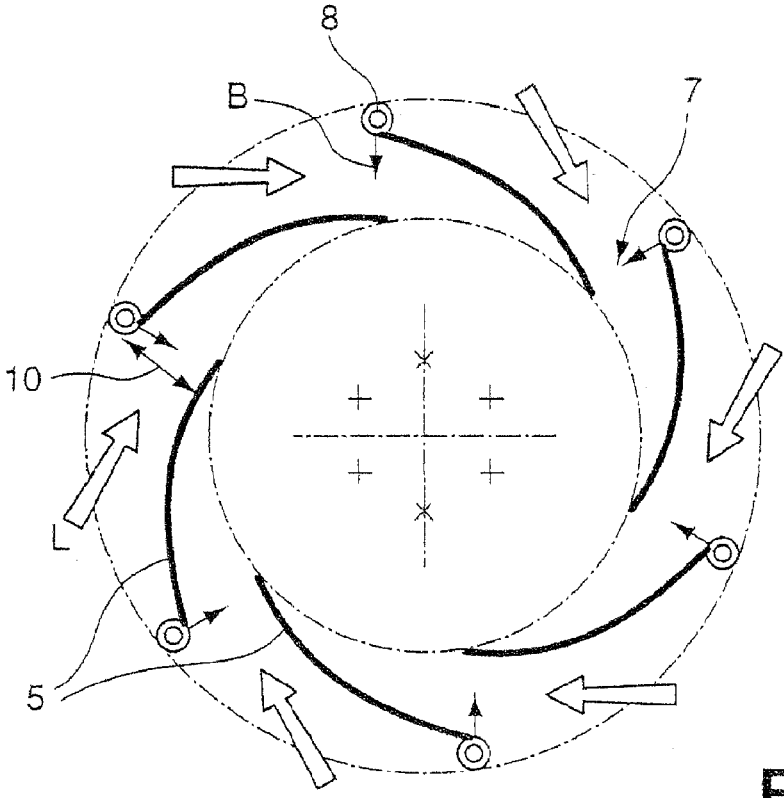
FIG. 3 shows a cross-sectional view through an exemplary vortex generator which is formed according to the present invention.

In order to increase the swallowing capacity of a premix burner according to the present invention, with otherwise constant overall sizes, i.e., especially with constant length of the premix burner 1 and also constant premix burner outside diameter Da and also inside diameter Di, the new type premix burner according to the cross-sectional view in FIG. 3, instead of n=4 partial cone shells provides n=6 partial cone shells 5 which include n=6 air inlet slots 7 in each case. The inlet slots 7 have the same maximum slot width 10 as in the case of the standard premix burner according to FIG. 2. Therefore, it is clear that the total area across which air L can reach into the interior of the vortex chamber 6 through the air inlet slots 7, is very much larger than in the case of a hitherto known premix burner, for example according to the embodiment in FIG. 2. The partial cone shells 5 in the premix burner which is formed according to the solution according to FIG. 3 are again arranged in a centrally offset manner in relation to each other, according to the partial cone shell middle points which are shown by a cross within the cross-sectional view according to FIG. 3.

By the increased swallowing capacity of the premix burner, the burner nominal velocity also increases at the same time, i.e., the flow velocity by which the fuel-air mixture which is formed inside the vortex generator is able to propagate axially to the burner axis A. So as not to affect the flame stability of the backflow zone which is otherwise formed spatially stably inside the combustion chamber, the exemplary embodiment according to FIG. 1, in the lower partial longitudinal sectional view, provides a tubular mixing element 4 which provides a flow cross-sectional contour which widens by the angle $\alpha$ in the flow direction and consequently acts as diffuser, as a result of which the axial velocity of the flow is decreased.

Equal to the number of the partial cone shells 5 which define or encompass the vortex chamber 6, as the case may be, transfer passages in the same number are also provided in the transition piece 2, therefore 6 transfer passages are provided for transfer of the vortex flow into the mixing path 3.

The example which is described above represents a premix burner with a mixing path which is connected downstream, a burner arrangement which is also referred to as an "Advanced Environmental Vortex-Burner (AEV burner)" by ALSTOM. An inventive idea, which relates to the increase of the burner capacity by an increase of the number of air inlet slots with otherwise constant burner geometries, however, is not only to be applied to premix burners with a mixing path which is connected downstream, rather an inventive idea is also applicable to generic type premix burners without mixing paths which are connected downstream. Such premix burners, which are referred to as an Environmental Vortex-Burner (EV-burner) by ALSTOM, are formed in an as known per se manner as double cone shell burners, i.e., the vortex chamber of the vortex generator is only encompassed by two partial cone shells, which altogether only define two air inlet slots. On the other hand, if three or more partial cone shells are used for defining the vortex chamber, wherein the individual air inlet slots have at least the width of the hitherto known air inlet slots, then the swallowing capacity of such an EV-premix burner can also be increased in this case, without the burner dimensions being altered with regard to length and diameter in the process.

LIST OF DESIGNATIONS

1 Premix burner
2 Transition piece
3 Mixing path
4 Mixer tube
5 Partial cone shell
6 Vortex chamber
7 Air inlet slot
8 Fuel feed line
9 Transfer passage
10 Gap width of an air inlet slot While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A premix burner for a heat generator, the burner comprising:

a conically widening chamber with an inside diameter defining the size of a vortex chamber and an axial length defining the length of the premix burner;

at least five partial cone shells making up a vortex generator encompassing the vortex chamber, wherein the partial cone shells mutually define tangential air inlet slots having slot widths and an outside premix burner diameter;

wherein the cone shells are configured and arranged to inject at least one gaseous fuel or liquid fuel along the air inlet slots; and a feed arranged along a burner axis which centrally passes though the vortex chamber;

wherein the premix burner is configured so that the output capacity of the premix burner is greater than the output capacity of a premix burner with the same burner length, inside diameter, and outside diameter, and less than five said partial cone shells by the number of partial cone shells, and the shape and size of the cone shells that define inlet slot widths being at least the same size as a burner with less than five said partial cone shells.

2. The premix burner as claimed in claim 1, further comprising:

a tubular mixing element forming a mixing path downstream to the vortex generator; and a transition piece with n transfer passages between the vortex generator and the mixing path for transfer of a flow when formed in the vortex generator into the flow cross section of the mixing path.

3. The premix burner as claimed in claim 2, wherein the tubular mixing element is formed at least in sections as a diffuser in the through-flow direction.

4. The premix burner as claimed in claim 3, wherein the mixing element directly downstream of the transition piece has a first flow section with a constant through-flow cross section; and further comprising a second flow section, with a through-flow cross section which conically widens in the flow direction by an angle $\alpha$, connected downstream to the first flow section.

* * * * *